US005990667A

United States Patent [19]

Degeneff et al.

[11] Patent Number: 5,990,667

[45] Date of Patent: Nov. 23, 1999

[54] REGULATOR WITH ASYMMETRICAL VOLTAGE INCREASE/DECREASE CAPABILITY FOR UTILITY SYSTEM

[75] Inventors: Robert C. Degeneff, Niskayuna; Steven Raedy, Schenectady, both of N.Y.

[73] Assignee: Utility Systems Technologies, Inc., Niskayuna, N.Y.

[21] Appl. No.: 08/957,569

[22] Filed: Oct. 24, 1997

[51] Int. Cl.[6] ..... G05F 1/16

[52] U.S. Cl. ..... 323/258; 323/343

[58] Field of Search ..... 323/255, 256, 323/257, 258, 340, 343, 345

[56] References Cited

U.S. PATENT DOCUMENTS

| | | | |
|---|---|---|---|
| 3,195,038 | 7/1965 | Fry . | |
| 3,319,153 | 5/1967 | Livingston . | |
| 3,461,378 | 8/1969 | King . | |
| 3,600,664 | 8/1971 | Goldberg et al. | 323/263 |
| 3,684,949 | 8/1972 | Yamachi et al. | 323/263 |
| 3,700,925 | 10/1972 | Wood | 327/461 |
| 3,786,337 | 1/1974 | Kugler | 323/343 |
| 3,909,697 | 9/1975 | Depenbrock | 323/126 |
| 4,135,126 | 1/1979 | Rubashev et al. | 323/343 |
| 4,220,911 | 9/1980 | Rosa | 323/343 |
| 4,627,292 | 12/1986 | Dekrone | 73/728 |
| 5,408,171 | 4/1995 | Eitzmann et al. | 323/258 |
| 5,604,423 | 2/1997 | Degeneff et al. | 323/258 |

OTHER PUBLICATIONS

"Magnetic Circuits and Transformers", The M.I.T. Press, Dept. of Electrical Engineering, pp. 394–399, (no date).

*Primary Examiner*—Y. J. Han
*Attorney, Agent, or Firm*—Heslin & Rothenberg

[57] ABSTRACT

A regulator is provided for establishing asymmetrical voltage increase/decrease capability between an input node and an output node for enhanced regulation of either a voltage sag or a voltage swell within a utility system. The regulator includes an autotransformer having an input tap coupled to the input node of the regulator and an output tap coupled to the output node. The regulator further includes an electronic tap changer system coupled to the winding of the autotransformer. Together, the autotransformer and the electronic tap changer system provide the regulator with its asymmetrical voltage increase/decrease capability between the input node and the output node thereof. The regulator can be configured for voltage increase only, voltage decrease only, or both, provided an asymmetrical voltage increase/decrease capability is defined.

28 Claims, 7 Drawing Sheets

REGULATOR WITH ASYMMETRICAL VOLTAGE INCREASE/DECREASE CAPABILITY FOR UTILITY SYSTEM

TECHNICAL FIELD

This invention relates in general to power utility systems, and more particularly, to a regulator for providing asymmetrical voltage increase/decrease capability for responding to a voltage sag or voltage swell, respectively, within the power system.

BACKGROUND OF THE INVENTION

This invention is directed to the arrangement of windings and electronic switches used in inductive devices (for example, transformers and regulators) in order to construct a more economical, fully electronic on-load tap changing mechanism. Tap changing is used extensively in a wide variety of electrical inductive apparatus, such as AC voltage regulating transformers, high voltage DC (HVDC) rectifier and inverter transformers and phase angle regulators, to adjust device turns ratio or phase angle while the device is serving load.

Most of the tap changing methods in present commercial use make use of a mechanical switching means to alternately connect various sections of winding of the electrical inductive apparatus into a circuit. One extensively used switching means is a mechanical contact switch in which a movable contact, which selectively engages stationary contacts, is connected to various sections of the winding in order to connect varying numbers of turns into the circuit. This technique is at present used to the virtual exclusion of all other methods in large power apparatus. In applications where these mechanical devices are used, the arrangement of the windings is such that the buck (decrease) and boost (increase) voltage capable of being provided will be the same magnitude. For example, in the utility industry in the United States of America the most common increase/decrease is ±10%.

The electronic switch is another type of switching means, which has generated significant interest recently due to its fast response time and lack of mechanical wear. Because of its fast reaction time it can be used to mitigate voltage sags and swells in addition to performing the more traditional duties of an on load tap changer such as voltage leveling. Electronic switches are typically electronically controlled gate devices, such as thyristors and gate turn-off (GTO) devices, which are configured as an inverse parallel-connected pair to each tap of a winding, as shown in U.S. Pat. No. 3,195,038. Further, tapped secondary windings may be utilized with appropriate switching devices to increase the tap range of the electrical inductive apparatus as shown in U.S. Pat. Nos. 3,195,038, 3,909,697 and also 3,700,925. U.S. Pat. No. 5,604,423 teaches an electronic tap changing concept of Discrete-Cycle Modulation (DCM) whereby tap voltage magnitudes are obtained in increments intermediate to the physical tap winding voltage magnitudes. Again, however, in the winding configurations demonstrated in these patents, the buck and boost voltage of the tap changer are the same magnitude.

Today, an increasing amount of industrial and commercial equipment contain electronic components and controls which will not function properly when the voltage supply fluctuates. For example, variable frequency drives, plastic fabrication equipment, microwave heating, and computers are some of the more common loads which are sensitive to supply voltage variations.

Deviations from the nominal ideal of 100% voltage magnitude result from many causes, the most common being voltage sag. Voltage sags are a decrease in the supply voltage that may last from 1 cycle to several seconds and may decrease the supply voltage by 10% to 80% of the nominal supply voltage. The occurrences of sags is the largest and most costly power quality problem facing industrial and commercial concerns today.

Therefore, there is a need in the power utility industry for a new electronic tap changer arrangement for a regulator or transformer which comprises a commercially viable arrangement and which particularly addresses the occurrence of sags within the electrical transmission and distribution system. The present invention addresses this need by providing a regulator/transformer with unsymmetrical boost/buck characteristics.

DISCLOSURE OF THE INVENTION

Briefly described, the invention comprises in one aspect a regulator for use within a power system. The regulator includes an input node and an output node, as well as an autotransformer having a winding and a tap changer system coupled to the winding of the autotransformer. The autotransformer is electrically coupled between the input node and the output node of the regulator. Taken together, the autotransformer and the tap changer system are configured such that the regulator has an asymmetrical voltage increase/decrease capability between the input node and the output node for enhanced regulation of either a voltage sag or a voltage swell, respectively, within the power system when used therein.

In a further aspect, the invention comprises a regulator for use within a power system. The regulator includes an input node and an output node, as well as an autotransformer having an input tap and an output tap. The input tap is intermediate an upper end and a lower end of a winding of the autotransformer. The input tap is coupled to the input node and the output tap is coupled to the output node. The regulator also includes a tap changer system coupled to the winding of the autotransformer. The autotransformer and the tap changer system are configured such that the regulator has an asymmetrical voltage increase/decrease capability between the input node and the output node for enhanced regulation of either a voltage sag or a voltage swell, respectively, within the power system when used therein.

In another aspect, the invention comprises a regulator for use within a power system which includes an input node, an output node, an autotransformer and a tap changer system. The autotransformer has an untapped common winding and a tapped series winding, and the input node and output node are electrically coupled to the autotransformer. Further, the tap changer system is coupled to the tapped series winding of the autotransformer. The regulator is characterized as having an asymmetrical voltage increase/decrease capability between the input node and the output node for enhanced regulation of either a voltage sag or a voltage swell, respectively, within the power system when the regulator is used therein.

In still another aspect, the invention comprises an inductive device for use within a power system. The inductive device has an input node, an output node, and an exciting winding and a series winding. The exciting winding and the series winding are electrically coupled together, and are electrically coupled between the input node and the output node. A tap changer system is connected to at least one of the exciting winding and the series winding. Taken together, the exciting winding, series winding and tap changer system provide the inductive device with an asymmetrical voltage increase/decrease capability between the input node and the output node for enhanced regulation of either a voltage sag or a voltage swell, respectively, within the power system when used therein.

Several general objectives of this invention will be clear to those skilled in the art from the following disclosure. First, an objective of the present invention is to provide a completely non-mechanical contact switching device having a high speed response and high reliability, as well as economical cost. Another objective of this invention is to provide reliable operation and switching independent of the nature of the load. Another general objective of the invention is to provide reliable switching action between any two tap settings including switching taps sequentially or selectively over the entire tap range. It is also the objective of this invention to provide control so that the switch can be operated such that the output RMS voltage is controllable and selectable between the distinct voltage increments dictated by the winding configuration.

More particularly, it is a specific object of this invention to provide an inductive device that uses an electronic on-load-tap changer to provide voltage regulation for a system that is subjected to unsymmetrical voltage excursions. Additionally, it is to achieve the stated objectives for a broad range of unsymmetrical voltage excursions. This device is economical to construct with the method disclosed herein for reducing the number and/or required rating of the controllable electronic devices necessary to provide the required boost/buck performance within the voltage tolerance specified.

This patent teaches how to arrange the thyristors and the regulator windings so that one portion of the regulator is designed for boost (or buck) only and another portion is for both boost and buck. This design allows optimization of the configuration so that the desired precision of voltage regulation is achieved in addition to accomplishing that precision with fewer thyristors. Additionally, the configuration is of a form such that the concepts taught in U.S. Pat. No. 5,604,423 for symmetrical on-load tap changers can also be applied to these non-symmetrical arrangements. In this way, the percentage of buck and boost voltage can be completely general and different, and a resultant winding-thyristor configuration will be a function of the economics of the thyristors, control, and inductive components.

Also, this patent teaches how to arrange the regulator winding, or an auxiliary transformer winding, and the electronic tap changer so that the most effective use of the thyristors is made. This optimization would also include utilizing the saturable characteristics of the windings to limit the current through the electronic switches during faults. This invention also embodies other capabilities inherent in solid state devices and transformer and control design. These would include, but not be limited to, the ability to control voltage and current independently on each phase of a multi-phase device, thereby achieving a desired distribution of load current on each conductor (which could be used, for example, to reduce the electromagnetic field associated with an electric power distribution system), and the ability to control power during load pick-up, inrush, solar induced currents (GIC), cold starts, and transient overload conditions to mitigate the effect on the power transformer. This invention also teaches the benefit of independently controlling each electronic switch within one or more back-to-back SCR pairs.

BRIEF DESCRIPTION OF THE DRAWINGS

The above-described objects, advantages and features of the present invention, as well as others, will be more readily understood from the following detailed description of certain preferred embodiments of the invention, when considered in conjunction with the accompanying drawings in which:

In FIG. 4 the windings are configured to boost only.

FIG. 7 depicts a regulator, auxiliary winding, and electronic tap changer configuration in accordance with this invention comprising a system which makes more efficient use of the electronic device. This implementation is advantageous in view of the discrete sizes thyristors are manufactured in.

BEST MODE FOR CARRYING OUT THE INVENTION

Figure 1:
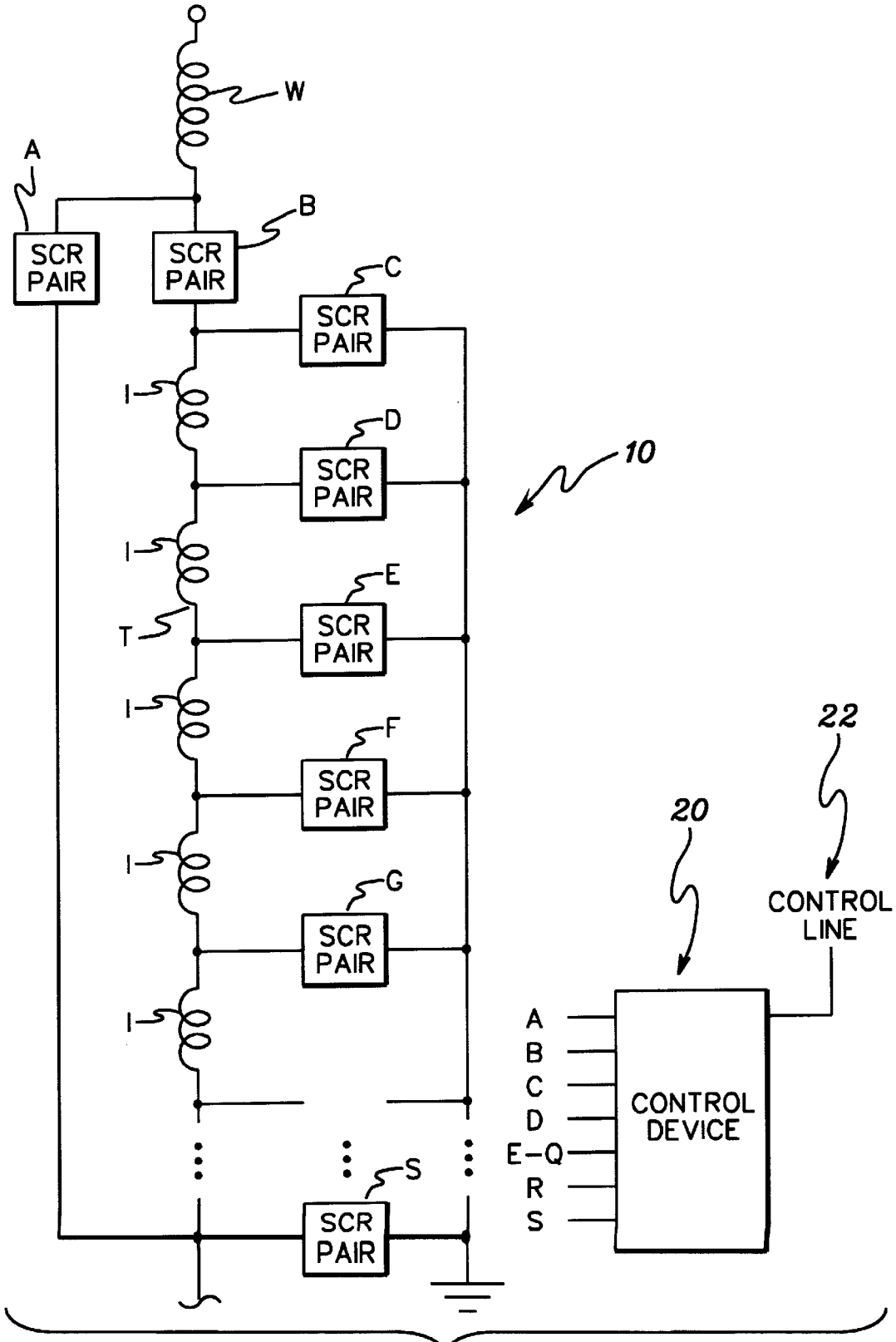
fig. 1 (PRIOR ART)
FIG. 1 depicts a winding of a regulator (or transformer) that uses a conventional strategy of back-to-back thyristor pairs located at each desired voltage tap location. The embodiment shown in FIG. 1 illustrates a balanced ±10% boost/buck capability.

As used herein, the term "regulator" is intended to include any inductive device, such as a regulator or a transformer, having an unsymmetrical boost/buck characteristic in accordance with the principles of this invention. Further, although this invention is described and claimed in connection with regulating voltage, the concepts are equally applicable to regulating current. In fact, if voltage is regulated to achieve an unsymmetrical boost/buck characteristic, then inherently, current regulation is also achieved. Also, although discussed in connection with frequencies applicable to power utility systems, i.e., 50–60 Hz., the concepts presented can be applied to regulating voltage within a wide range of frequencies, for example, up to 1,000 Hz. and beyond.

The most common type of voltage variations within a utility system are voltage sags and they comprise more than 90% of all voltage variations. Voltage sags often cause misoperation of equipment containing electronic components. These voltage sag events have two important characteristics.

First, the sag or voltage dip occurs faster that the reaction time of a mechanical tap changer. As such the mechanical tap changer can not respond quickly enough to adequately adjust the voltage to remove the problem. Typically, mechanical tap changers react in 1 to 3 seconds (60 to 180 cycles on a 60 Hz. system) and voltage sags can occur in less than 1 cycle. Thus, a mechanical tap changing mechanism, while the most common mechanism in use today, cannot be used to mitigate or immediately correct the adverse effect of voltage sags.

Second, voltage sags are by nature a large decrease in voltage which requires a correspondingly large voltage boost (increase) capability within the regulator-tap changer system if the voltage boost capability of the regulator is to be used to mitigate the adverse effect of the voltage sag. Conventional mechanical tap changers and previously proposed electronic tap changers, however, are applied with equal boost/buck characteristics or as a simple replacement of the mechanical switch with an SCR back-to-back pair. To achieve the needed voltage boost by applying a tap changer with equal boost/buck capability is costly since a large part of the capability of the electronic device is not utilized.

This patent therefore teaches a tap changer and regulator configuration which achieves a non-symmetrical boost/buck characteristic for modern power systems at a low cost.

The major reason electronic tap changers have to date not gained wider commercial acceptance is their high cost compared to the cost of mechanical tap changers. U.S. Pat. No. 5,604,423 teaches an electronic tap changing concept of Discrete-Cycle Modulation whereby tap voltage magnitudes are obtained in increments intermediate to the physical tap winding voltage magnitudes contained in the physical inductive product. This allows fewer thyristors to be used to achieve a desired voltage output precision. Additionally, this patent teaches the concept of fault current rotation to reduce the size of the thyristor needed to meet a given steady state and fault current rating.

However, the configurations taught in this patent, and most, if not all other patents describing electronic tap changers, are for applications where symmetrical buck-boost capability is required. The issue of a non-symmetrical boost/buck requirement is not believed to have been addressed.

A major element of cost for a regulator-electronic tap changer system is cost of the electronic switches in the tap changer. The cost results from the total number of electronic switches, their individual ratings, their associated losses and individual winding sections within the inductive device required to provide a predetermined number of output voltage increments. Thus, the cost of a tap changer mechanism could be reduced if fewer thyristor switches of lower rating are used with a simpler winding configuration.

Prior art electronic tap changing arrangements have drawbacks regarding these considerations since they require an excessive number of switches and individual winding sections to provide a large number of discrete output voltage increments required for commercial applications. U.S. Pat. No. 5,604,423 teaches an efficient method to arrange and utilize thyristors to reduce the cost of the materials in the electronic tap changer; however, this patent focuses on tap changer applications which employ equal boost/buck capability. At present, there is no commercially viable regulator arrangement employing an unsymmetrical boost/buck characteristic, nor is there such a regulator using a solid-state or electronic tap changer. This patent teaches how to arrange for unsymmetrical boost/buck characteristics using solid-state tap changers.

Before proceeding with the description of certain preferred embodiments of the invention, reference is made to FIG. 1 in which a conventional solid state tap changer 10 employing groups of thyristor devices A–S is illustrated. This solid state tap changer 10 constitutes an extension of the previously mentioned mechanical load tap changer, such as described in U.S. Pat. No. 3,195,038.

In FIG. 1 "SCR PAIR" denotes, for example, an antiparallel combination of thyristors, or simply a back-to-back pair of thyristors. Thyristor pairs A and B are connected to allow reversing of the current flow in the tap winding; that is, turns can be added or subtracted by current flow in respectively opposite directions determined by the gating signals to the thyristors by control device 20. Accordingly, if zero additional turns are desired, current would -14- 1090.007 flow only through the thyristors in groups B and C and thence to reference potential (ground) in the tap changer 10. To add a single tap, control device 20 sends gating signals to thyristor groups B and D. To obtain a reduction of a single tap, control 20 applies control signals to thyristor groups A and R. Correspondingly, for adding two taps (each tap winding shown having a value of 1) thyristor pairs B and E would be gated with appropriate control signals, and for adding three taps, groups B and F would be activated, etc.

As will be appreciated, control device 20 functions responsive to input on a control line 22, to provide the control signals to the gates of the thyristor back-to-back pair groups A–S at the proper time to provide a desired turns ratio. In FIG. 1, control is accomplished electrically by extending the output control lines A–S, seen on the left side of control device 20, to the respective gates of each thyristor pair of the groups A–S. This effect can also be accomplished optically or by other suitable means.

Conventional power system tap changers in the United States of America are designed for plus-minus 16 steps or taps, with each tap step being approximately 5/8% of the winding's nominal voltage. If this is the assumed arrangement for tap changer 10 of FIG. 1, then 19 back-to-back thyristor pairs would be required to construct this system. Each of these 19 back-to-back pairs would be rated for the full short-circuit current the system could deliver during a fault. From this it will be appreciated that the cost of this electronic configuration, based on a conventional tap winding design, is substantial since each of the thyristors or SCR pairs has to be rated to carry the short-circuit current limited only by the impedance of the transformer for the length of time dictated by ANSI standards. This standard is complex, but in general class III transformers are required to withstand a fully offset short-circuit for at least 1 second. Users can and do specify other fault current duties including 1 second on, x seconds off, and 1 second on again.

It will be understood that, although FIG. 1 shows a transformer winding, and reference will be made hereinafter to transformers and reactors, that other types of inductive devices, such as voltage or current regulators or rotating machines and the like, can be utilized with the present invention. As used herein, the term "regulator" is intended to encompass all such devices wherein an asymmetrical power increase/decrease capability in accordance with this invention can be employed.

Figure 2:
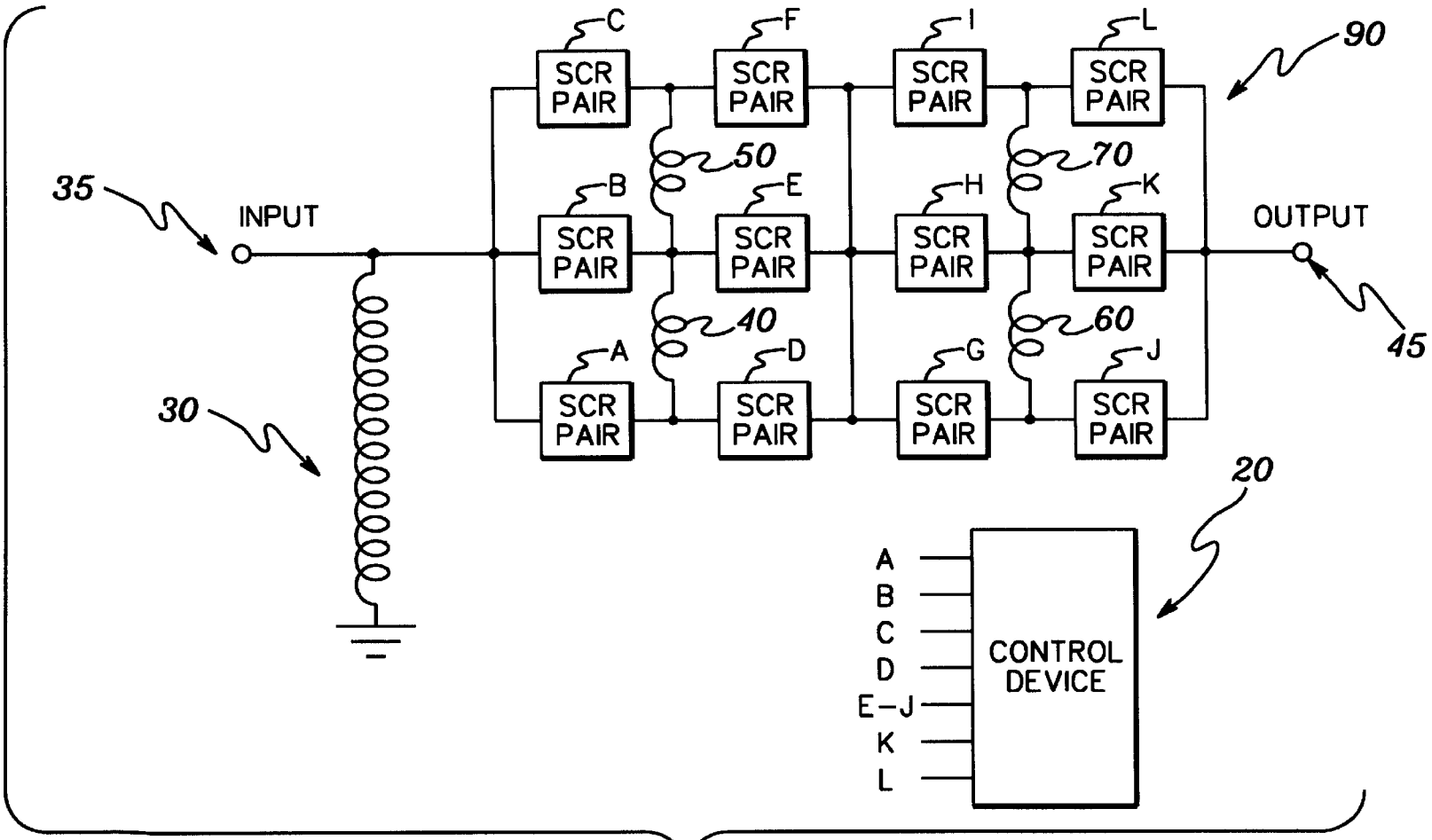
fig. 2 (PRIOR ART)
FIG. 2 depicts a regulator (or one winding of a transformer) that also has a symmetrical boost/buck capability using the concept of discrete cycle modulation and fault rotation taught in U.S. Pat. No. 5,604,423. The embodiment shown in FIG. 2 illustrates a balanced ±25.5% boost/buck capability.

FIG. 2 is an example of the tap changer arrangement taught in U.S. Pat. No. 5,604,423 applied to a regulator. This commonly assigned U.S. Pat. No. 5,604,423, by Degeneff et al., entitled "Tap Changing System Having Discrete Cycle Modulation And Fault Rotation For Coupling To An Inductive Device", is hereby incorporated herein by reference in its entirety. The concepts of windings topology (configuration), DCM (discrete cycle modulation), and rotation of current during a fault disclosed in this incorporated patent can be applied to a voltage regulator design in accordance with the present invention as well.

As noted, conventional onload tap changers are designed for operation with an equal voltage boost and buck range or capability. As such, assuming FIG. 2 is arranged to replace the tap changer shown in FIG. 1, then winding 30 (the common portion of the regulator winding) would have 100% turns, and the series portion 90 of the regulator would have 10% turns, This could be accomplished by having windings 40 and 50 with 3.125% turns, winding group 60 with 1.25% turns, and winding group 70 with 2.5%. As such, this arrangement requires only 12 back-to-back SCR pairs A–L.

In the same manner as discussed for FIG. 1 and using the strategy outlined in U.S. Pat. No. 5,604,423, the control element 20 sends the appropriate gate signals to the electronic switches so that a desired output voltage would be achieved. For example, if an output voltage of +5/8% is desired, control 20 alternately gates SCR pairs A, D, G, J and A, D, G, K. The details of this gating scheme are discussed in detail in the above-incorporated U.S. Pat. No. 5,604,423.

A transformer or regulator designed for ±10% boost/buck will not provide a large enough voltage regulation (boost or buck) range to provide mitigation of a voltage sag occurring in a realistic power system, which may, e.g., comprise a 20% to 80% sag. If it is desired to use the FIG. 2 device to mitigate sags up to, for example 25.5%, then windings 40, 50, 60, and 70 would have to be sized to provide 25.5% boost. In FIG. 2, such a winding arrangement would have winding 30 with 100% turns, windings 40 and 50 with 10.5% turns each, winding 60 with 1.5% turns, and winding 60 with 3.0% turns. This would provide a 25.5% boost in the series portion of the regulator 90. In FIG. 2, the electronic tap changer would have to have 25.5% of the KVA rating of the transformer or regulator.

Note that FIG. 2 is more efficient in its use of thyristors than the configuration shown in FIG. 1 if the desire is to achieve either a ±10% or ±25.5% boost/buck. The configuration of FIG. 1 requires 19 electronic switches, while that of FIG. 2 requires only 12. However, the embodiments of both FIG. 1 and FIG. 2 have the capability (and limitation) to both boost and buck power by an equal amount. In accordance with this invention, the buck (decrease) capability is of little value in a practical utility application where voltage sags are of principal concern.

Figure 3:
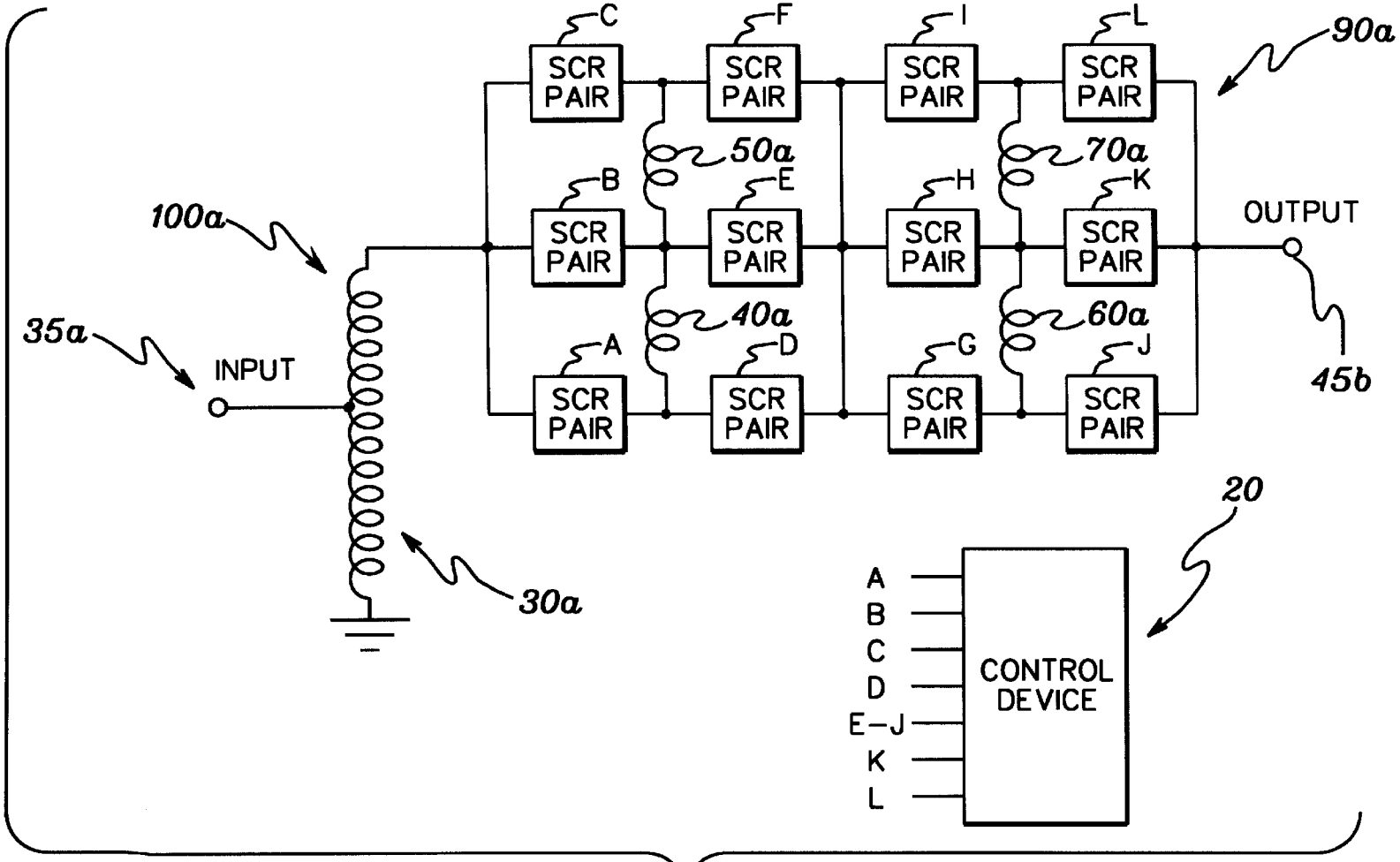
FIG. 3 depicts a regulator that has a unsymmetrical boost/buck characteristic in accordance with the principles of the present invention. This regulator employs an autotransformer and an electronic tap changer with a balanced buck-boost characteristic.

Thus, pursuant to the principles of the present invention, regulator embodiments having asymmetrical boost/buck capability are provided in response to applicants' recognition that power sags are of much greater frequency and concern in the power utility industry than are power swells. FIG. 3 of the present invention implements a design which boosts (increases) output voltage over input voltage +25.5% and bucks (decreases) output voltage 0% between an input node 35 and an output node 45. In FIG. 3, winding 30*a* is 100% turns, winding 100*a* is 12.75% turns, and the combination of windings 30*a* and 100*a* comprise an "autotransformer" which boosts the voltage to the midpoint of the desired voltage range of the electronic tap changer. The electronic tap winding 90*a* then has a ±12.75% voltage capability. Applying the same winding strategy used in FIG. 2, windings 40*a* and 50*a* have 5.25% turns, winding 60*a* has 0.75% turns, and winding 70*a* has 1.5% turns. During operation, the selection of the appropriate SCR pair would be controlled by control device 20.

The winding sizes, e.g., 30*a*, 40*a*, 50*a*, 60*a*, 70*a*, and 100*a* will be determined by the application and the specific system requirements for voltage boost and/or buck. An advantage of the configuration depicted in FIG. 3 is that the KVA of the tap changer is reduced by 50% while the KVA of the regulator winding in only increased 12.5%. This is significant since the cost of a KVA of electronic capability is several times that of a KVA of inductive equipment. Also, FIG. 3 would be able to take advantage of the techniques taught in U.S. Pat. No. 5,604,423.

As noted, in the example of FIG. 3, the regulator has only a boost capability, e.g., +25.5/−0%, and that this is achieved by using a +12.75% autotransformer winding in conjunction with a ±12.75% electronic tap changer arrangement. Clearly, if the desire were to have a regulator or transformer with another boost-buck capability it could be accomplished by adjusting the autotransformer-tap changer relationship. For example, if the system required a +20.5/−5.0% voltage, this could be accomplished with the same electronic tap changer 90*a*, with a ±12.75% range, and a +7.5% autotransformer with winding 30*a* at 100% and winding 100*a* at 7.5%. Alternately, if the system required a +35.5/−10.0% boost/buck capability, this could be accomplished with the electronic tap changer 90*a* having a ±22.75% tap range and the previously used +12.75% autotransformer, e.g., winding 30*a* with 100% turns and winding 100*a* with 12.75% turns. Further, the examples provided have used the concept of boosting the voltage a larger amount than bucking. Clearly, applications could be encountered where the need to reduce the voltage is greater than the need to increase it. An aspect of all these embodiments is that the regulator possesses an asymmetrical boost/buck capability.

Figure 4:
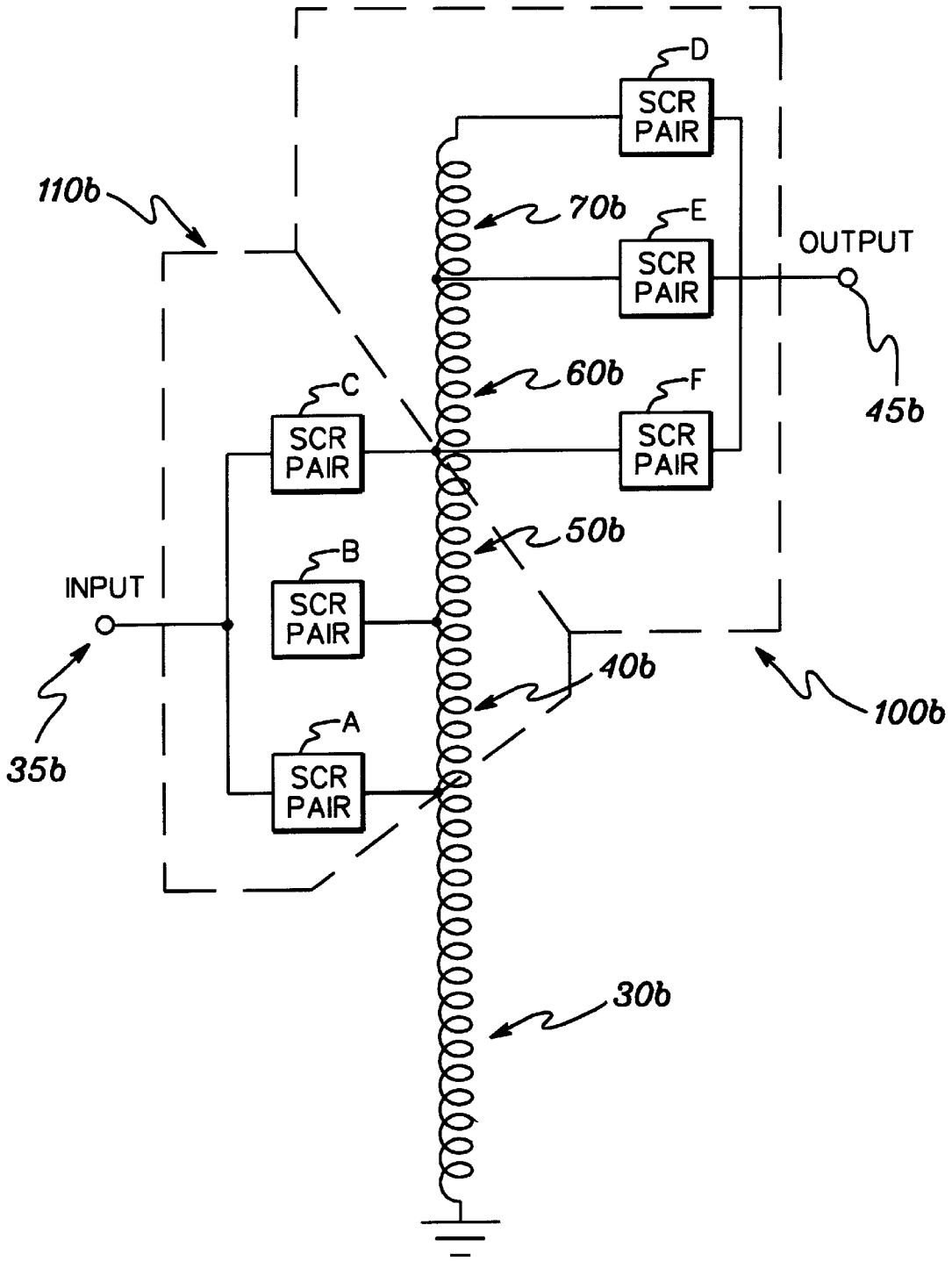
FIG. 4 depicts another embodiment of a regulator having an unsymmetrical boost/buck characteristic in accordance with the present invention. This characteristic is achieved by making use of a continuous regulator winding subdivided into several groups of large turns and another group of winding subdivisions comprised of an integer fraction of the larger winding subdivision.

FIG. 4 teaches an arrangement which subdivides the tapped winding into three groups of turns. The first group of turns, labeled 30*b* in FIG. 4, is the untapped common portion of the winding. The second group of turns 110*b*, comprises first tapped portions 40*b*, 50*b* of the series winding, and the third group of turns is a second tapped portion 100*b* of the series winding, comprising windings 60*b* and 70*b*. In this example, the tapped portion of series winding 110*b* is divided into two equal groups of turns 40*b* and 50*b*. The number of divisions can be as small as 1 and as large as necessary to meet a given requirement. Additionally, the divisions within winding group 110*b* are not required to be equal and could be varied to achieve a desired voltage output characteristic. In this example, the second portion 100*b* of the series winding is divided into two groups of turns 60*b* and 70*b*. The number of divisions can again be as small as one or as large as necessary to meet the requirement at hand. Additionally, the turns within series winding 100*b* are not required to be equal and could be varied to achieve a desired voltage output characteristic. It is believed efficient, however, to have the total number of turns in the second series winding 100*b*, be 50% of the turns in winding section 40*b* or section 50*b*.

Pursuant to this invention, FIG. 4 teaches an alternate arrangement to the embodiment of FIG. 3. This arrangement makes more efficient use of the number and rating of thyristors and allows the tap changer to efficiently supply a non-symmetric boost-buck requirement. The arrangement in FIG. 4 also allows DCM and fault rotation taught in U.S.

Pat. No. 5,604,423 to be used to advantage. The number of electronic switches (e.g., back-to-back thyristor pairs) in this configuration is 6 rather than 19 with FIG. 1 or 12 with FIGS. 2 or 3.

One method for determining the number of turns in each of the winding sections is next presented. If the input boost requirement is x, then the per unit winding turns in winding section 30*b* is given by 1/(1+x). If winding section 110*b* is to be subdivided into n groups of equal turns, then the total number of turns in winding section 100*b* is given by $$\left[\frac{1}{2n+1}\right]\left[\frac{x}{1+x}\right]$$

and the number of turns in each of the n winding sections in 110*b* will be given by $$\left[\frac{1}{2n+1}\right]\left[\frac{x}{1+x}\right].$$

The subdivision of winding section 100*b* can be made in a number of ways, with one method being to subdivide the turns so that each of the winding sections within section 100*b* are equal. One method of apportioning the windings into groups would be to insure that voltage regulation can be obtained in uniform increments over the entire range of the regulator. An alternate apportioning strategy would be to gain precision with a portion of the regulation domain at the expense of precision in another area of the regulation domain.

If the boost/buck capability of the regulator shown in FIG. 4 is +25.5/−0.0% then winding 30*b* will have approximately 79.7% turns (this is 1/(1+0.255)), windings 40*b* and 50*b* will have 8.13% turns each, and windings 60*b* and 70*b* will have 2.03% turns each. The windings shown in FIG. 4 have been subdivided into a main winding 30*b*, two regulator windings on the input side (i.e., windings 40*b* and 50*b*), and two windings on the output side (i.e., windings 60*b* and 70*b*). Clearly, these winding divisions will be a function of the system requirements (boost-buck requirements) and output voltage precision requirements. In the above example, the output voltage could be held within 1.01% or one half of 2.03%. Using the above-incorporated concept of discrete cycle modulation, the voltage could be held to less than 0.5% with the configuration of FIG. 4.

FIG. 4 illustrates the general concept of subdividing the tapped winding by arranging the winding with the untapped series portion of the winding 30*b* at the bottom of the winding, then the two divisions of tapped series winding located adjacent to each other. For example, winding 30*b* is at the bottom, then winding 110*b*, and finally winding 100*b*. This arrangement could be varied without departing from the scope of the present invention. For example, the windings could be arranged as 110*b* at one end, the untapped winding 30*b* in the center, and the other tapped winding portion 100*b* at the other end. Also, FIG. 4 shows SCR switches A, B, and C on the input side of the winding and SCR switches D, E, and F on the output side of the winding. Clearly, SCR pairs A–F could be arranged on the same side of the winding.

Additionally, advantage may be taken by controlling the relationship between the size of the winding groups in the different tapped winding sections. For example, in FIG. 4 the total number of turns in the output winding (i.e., group 60*b* plus 70*b*) is determined by dividing an integer into one half of the winding size on the input side, e.g., turns in winding 60*b* plus 70*b* are equal to 8.13/2 or 4.06% in this case. The apportionment of the turns between winding sections is a function of the desired specification, but often is determined by an integer ratio. In this example, the turns were equally distributed, 1 to 1. This provides the highest output voltage precision with the smallest number of thyristor locations. More precise output voltage regulation could be achieved by dividing winding 100*b* into three or more divisions. If 3 equal divisions of turns were selected within winding 100*b* each winding would be 8.13/2/3=1.35% with an output tolerance of half this or 0.67%. Additionally, if DCM were used the precision could be increased to 0.34%.

FIG. 4 teaches an efficient method for arranging the thyristors when only boost or only buck regulation is required. Often, it is desirable to boost a large amount, but retain a modest buck capability. This type of requirement is met by the embodiment illustrated in FIG. 5.

Figure 5:
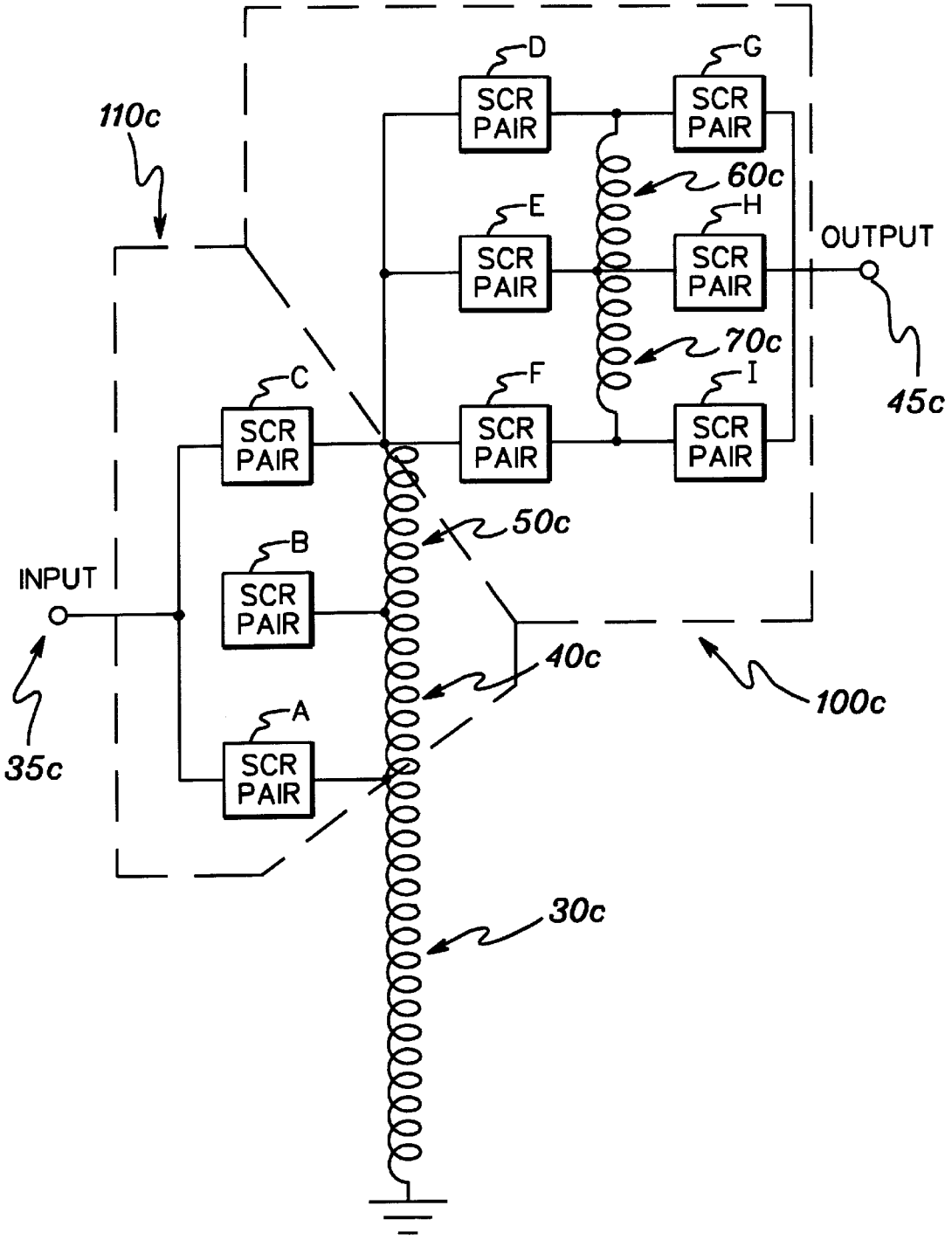
FIG. 5 depicts still another embodiment of a regulator in accordance with the present invention. This embodiment has an unsymmetrical boost/buck characteristic achieved by making use of a split winding with one portion of the winding containing a group of winding sections capable of only boost or buck, and the other portion of the winding being capable of both boost and buck.

FIG. 5 teaches an arrangement that again subdivides the tapped winding into three main portions. The first portion 30*c* is the untapped common portion of the winding. The second portion 110*c* is a tapped portion of the series winding, similar to that depicted in FIG. 4. In FIG. 5, winding section 110*c* is again configured to boost only. The third portion of the winding is a second tapped portion 100*c* of the series winding. In FIG. 5, winding and thyristor arrangement 100*c* both boosts and bucks voltage.

In this example, the tapped portion 110*c* of the series winding is divided into two equal groups of turns 40*c* and 50*c*. The number of divisions can be as small as one or as large as necessary to meet a given requirement. Additionally, the divisions within winding group 110*c* are not required to be equal and could be varied to achieve a desired voltage output characteristic. The second portion 100*c* of the series winding is divided into two equal groups of turns 60*c* and 70*c*. The number of divisions can again be as small as one or as large as necessary to meet a given requirement. Additionally, the turns within series winding 100*c* are not required to be equal and could be varied to achieve a desired voltage output characteristic. It is often efficient to have the total number of turns in the second series winding 100*c* (e.g., the turns in 60*c* plus the turns in 70*c*) be approximately 50% of the turns in winding section 40*c* or 50*c*. In FIG. 5, all winding sections 30*c*, 100*c*, and 110*c* are assumed to be arranged on the same core.

FIG. 5 teaches an arrangement that makes more efficient use of the number and rating of thyristors and allows the tap changer to efficiently supply a non-symmetric boost/buck capability. The arrangement in FIG. 5 also allows the DCM and fault rotation concepts taught in U.S. Pat. No. 5,604,423 to be used to advantage. The number of electronic switches (e.g., back-to-back thyristor pairs) in this configuration is now 9 rather than 19 with FIG. 1 or 12 with FIG. 2 or 3.

If the boost/buck capability of the regulator shown in FIG. 5 is assumed to be +25.5/−4.2%, then winding 30*c* will have 79.7% turns (this is 1/(1+0.255)), windings 40*c* and 50*c* will have 8.13% turns each, winding 60*c* will have 2.70% turns and winding 70*c* will have 1.35% turns. The windings shown in FIG. 5 have been subdivided into a main winding 30*c*, two regulator windings (40*c*, 50*c*) on the input side, and two windings (60*c*, 70*c*) on the output side. Clearly, the particular winding divisions will be a function of system requirements (boost/buck requirements) and output voltage precision requirements. In the example of FIG. 5, the output voltage could be held within 0.67% or one half of 1.35%. Using the concept of discrete cycle modulation the voltage could be held to less than 0.33%.

FIG. 5 again illustrates the concept of subdividing the tapped winding by arranging the winding 30*c* with the untapped series portion at the bottom of the winding, then the two divisions 110*c* & 100*c* of the tapped series winding located adjacent to each other. Clearly, this arrangement could be varied. For example, the windings could be arranged as winding 110*c* at one end, untapped winding 30*c* in the center, and winding portion 100c at the other end. Also, FIG. 5 shows the SCR switches A, B, and C on the input side of the winding and SCR switches D, E, F, G, H, and I on the output side of the winding. These switches could all be arranged on the same side of the winding.

Additionally, advantage may be taken by controlling the relationship between the size of the winding groups in the one winding tapped section and the other tapped section. For example, in FIG. 5 the total number of turns in the output winding (60*c* plus 70*c*) is determined by dividing an integer into one half of the winding size on the input side, e.g., 8.13/2 is 4.06% in this case. This provides the highest output voltage precision with the smallest number of thyristor locations.

If 3 equal divisions of turns were selected within winding section 100*c* each winding would be 8.13/2/3=1.35% with an output tolerance of half this or 0.67%. Additionally, if DCM were used the precision could be increased to 0.34%.

Figure 6:
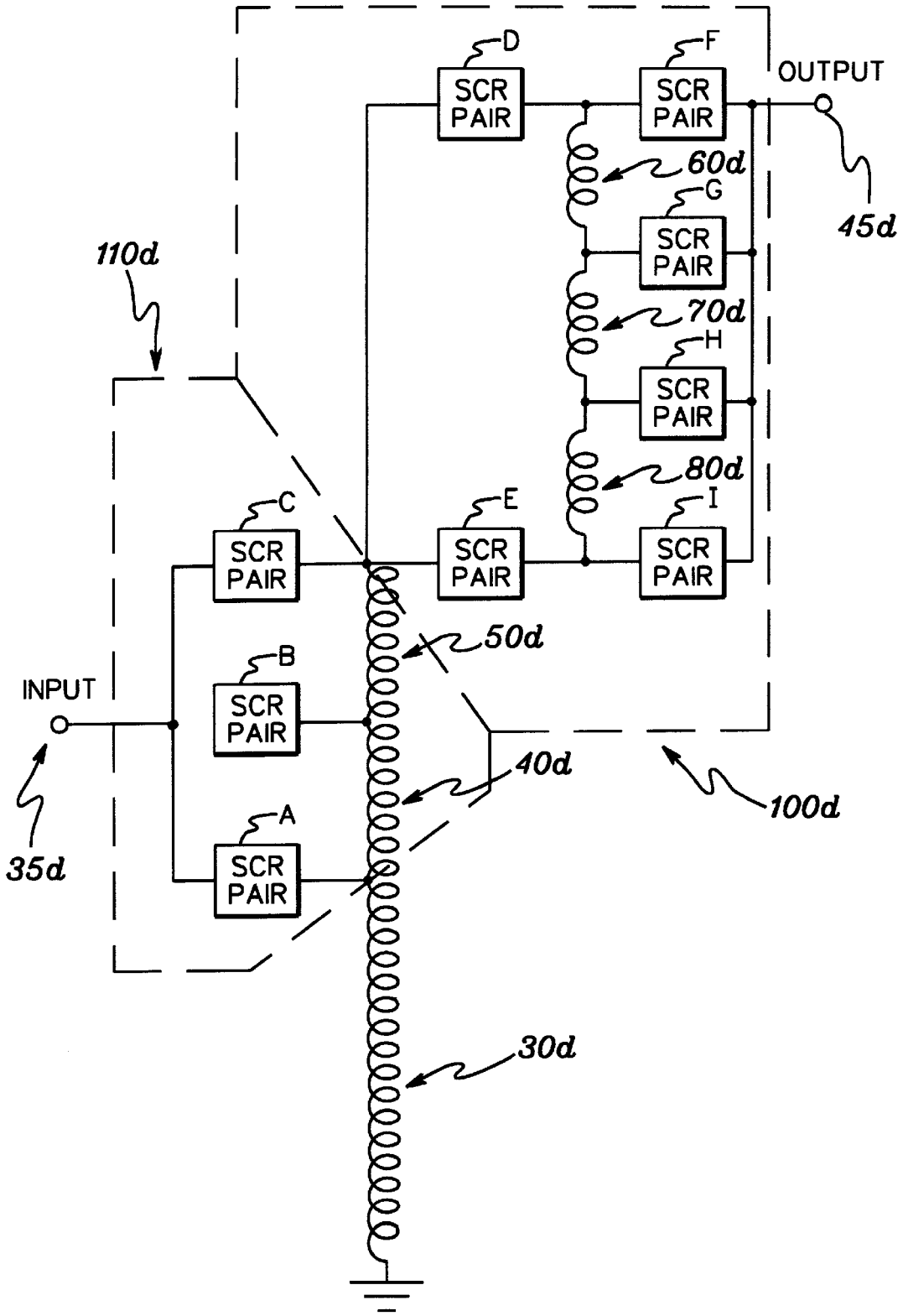
FIG. 6 depicts a further embodiment of a regulator pursuant to this invention wherein an unsymmetrical boost/buck characteristic is achieved by making use of a split winding, with one portion of the winding containing a group of winding sections used only for boost or buck, and the other portion of the winding being capable of both boost and buck voltage. The portion of the winding that is used for both boost and buck comprises an alternate design for the corresponding portion of the regulator of FIG. 5.

FIG. 6 illustrates a further arrangement in accordance with the present invention. This arrangement subdivides the tapped winding into three main portions in a manner similar to that taught in FIG. 5. The first portion 30*d* is again the untapped common portion of the winding. The second portion 110*d* is a first tapped portion of the series winding, and the third portion of the winding is a second tapped portion 100*d* of the series winding. Tapped portion 100*d* of FIG. 6 is different than the second tapped portion 100*c* of FIG. 5. Both, however, accomplish the same end. In FIG. 6, winding and thyristor arrangement 100*d* can be used to both boost and buck voltage between input node 35*d* and output node 45*d* by appropriate gating of thyristors E and D. It is often efficient to have the total number of turns in the second series winding 100*d* (i.e., turns 60*d*, 70*d* and 80*d*) be approximately 50% of the turns in the smallest section (e.g., 40*d* or 50*d*) of the other tapped winding. In FIG. 6, all winding sections 30*d*, 100*d*, and 110*d* are assumed to be arranged on the same core. The capability of the arrangement of FIG. 6 is similar to the above-discussed configuration of FIG. 5.

In many instances the voltage or current of a winding is such that it does not allow an economical or practical application of a tap changer, either mechanical or electronic. This is because the size of electronic components that are commercially available often will not allow the economical (or even physical) design of a system. This situation has been addressed with mechanical tap changers through the use of two coordinated windings, e.g., an exciting winding and a series winding. Properly coordinated, such an arrangement allows the current or voltage to be brought within acceptable limits and an acceptable system constructed. This same method has been suggested for use with electronic tap changers. Once again, however, the discussion and all practical applications proposed have been on systems where the boost/buck requirements are equal.

Figure 7:
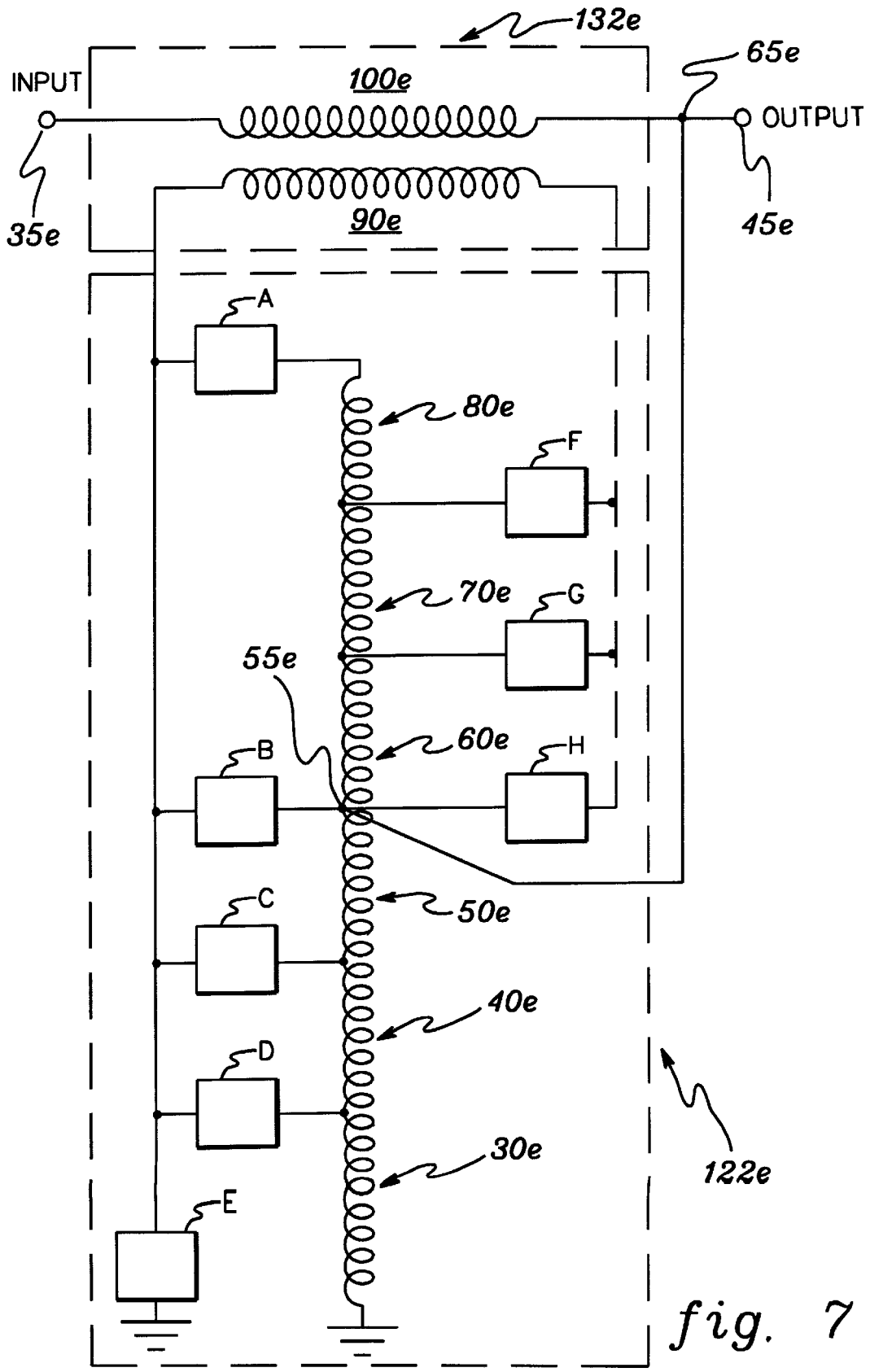

FIG. 7 depicts a transformer arrangement using the concepts taught in FIGS. 3–6, again for application to a system requiring an asymmetrical boost/buck capability. The arrangement of FIG. 7 consists of an exciting winding 122*e*, and a series winding 132*e*. The exciting winding is constructed using one of the configurations taught in FIGS. 3–6, or a variation thereof. In this specific example, winding 122*e* contains winding sections 30*e*, 40*e*, 50*e*, 60*e*, 70*e* & 80*e*. The series transformer 132*e*, which is on a separate core, contains windings 90*e* and 100*e*.

By way of example, if the turns ratio of series transformer 132*e* is 1:3.5 (winding 100*e* to 90*e*), and windings 30*e*, 40*e* and 50*e* contain 3n turns each, while windings 60*e*, 70*e* and 80*e* each contain n turns, this arrangement would provide a 35%/9.5% boost/buck capability. To boost voltage 35%, back-to-back SCR pairs E and F would be gated, while to buck 9.5%, back-to-back SCR pairs A and H would be gated. To obtain an intermediate voltage, the strategy discussed previously herein would be followed.

The use of a series transformer 132*e* as shown in FIG. 7 affords an additional advantage when the regulator is subjected to fault currents. Under normal operating conditions, an ampere turn balance is maintained between windings 100*e* and 90*e* of the series transformer 132*e*. During normal operation, electronic switches A–H would only be expected to conduct the load current times the series transformer's turns ratio. However, the series transformer 132*e* may be designed so that under fault current conditions, the iron core of the series transformer magnetically saturates, and thereby greatly reduces the current and voltage carried in winding 90*e*. This also reduces the current that electronic switches A–H would have to carry.

While the invention has been described in detail herein in accordance with certain preferred embodiments thereof, many modifications and changes therein may be effected by those skilled in the art. Accordingly, it is intended by the appended claims to cover all such modifications and changes as fall within the true spirit and scope of the invention.

We claim:

1. A regulator for use in a power system, said regulator comprising:

an input node and an output node;

an autotransformer having a winding, said autotransformer being electrically coupled between said input node and said output node;

a tap changer system electrically coupled to said winding of said autotransformer; and wherein said regulator has an asymmetrical voltage increase/decrease characteristic between said input node and said output node for enhanced regulation of either a voltage sag or a voltage swell, respectively, within the power system when used therein.

2. The regulator of claim 1, wherein said tap changer system comprises an electronic tap changer system, said electronic tap changer system comprising a plurality of switching units and a controller for selectively activating selected ones of said switching units to provide a desired voltage increase/decrease between said input node and said output node of said regulator.

3. The regulator of claim 2, wherein said tap changer system provides said regulator with greater voltage increase capability than voltage decrease capability.

4. The regulator of claim 2, wherein said plurality of switching units comprise a plurality of electronic switches, at least some of said electronic switches each comprising back-to-back pairs of thyristors, each thyristor of said back-to-back pairs being capable of being independently gated.

5. A regulator for use within a power system, said regulator comprising:

an input node and an output node;

an autotransformer having an input tap and an output tap, said input tap being intermediate an upper end and a lower end of a winding thereof, said input tap being electrically coupled to said input node and said output tap being electrically coupled to said output node;

a tap changer system coupled to said winding of said autotransformer; and wherein said regulator has an asymmetrical voltage increase/decrease characteristic between said input node and said output node for enhanced regulation of either a voltage sag or a voltage swell, respectively, within the power system when used therein.

6. The regulator of claim 5, wherein said tap changer system comprises an electronic tap changer system, said electronic tap changer system comprising a plurality of switching units and a controller for selectively activating selected ones of said switching units to provide a desired voltage increase/decrease between said input node and said output node of said regulator.

7. The regulator of claim 6, wherein said output tap is at the upper end of said winding of said autotransformer, and wherein said tap changer system is coupled between said output tap and said output node of the regulator.

8. The regulator of claim 7, wherein said tap changer system has a symmetrical voltage increase/decrease characteristic between said output tap and said output node, while said regulator provides said asymmetrical voltage increase/decrease characteristic between said input node and said output node.

9. The regulator of claim 7, wherein said tap changer system provides said regulator with greater voltage increase capability than voltage decrease capability.

10. The regulator of claim 7, wherein said tap changer system provides said regulator with only voltage increase capability.

11. The regulator of claim 6, wherein said plurality of switching units comprise a plurality of electronic switches.

12. The regulator of claim 5, wherein said tap changer system provides said regulator with only voltage increase capability between said input node and said output node.

13. A regulator for use within a power system, said regulator comprising:

an input node and an output node;

an autotransformer having an untapped common winding and a tapped series winding, said input node and said output node being electrically coupled to said autotransformer;

a tap changer system coupled to said tapped series winding of said autotransformer; and wherein said regulator has an asymmetrical voltage increase/decrease characteristic between said input node and said output node for enhanced regulation of either a voltage sag or voltage swell, respectively, within the power system when said regulator is used therein.

14. The regulator of claim 13, wherein said tap changer system comprises a first tap changer section and a second tap changer section, said first tap changer section being coupled to said input node and a first portion of said tapped series winding, and said second tap changer section being coupled to a second portion of said tapped series winding and to said output node.

15. The regulator of claim 14, wherein said first tap changer section and said second tap changer section comprise multiple switching units, and wherein said tap changer system comprises a controller for selectively activating selected ones of said multiple switching units to provide a desired voltage increase/decrease between said input node and said output node of said regulator.

16. The regulator of claim 15, wherein said multiple switching units of said first tap changer section and said second tap changer section comprise multiple electronic switches.

17. The regulator of claim 15, wherein said first tap changer section has a larger number of winding turns between taps of said tapped series winding than said second tap changer section.

18. The regulator of claim 17, wherein said regulator provides voltage increase capability only between said input node and said output node.

19. The regulator of claim 18, wherein a first end of said common winding is grounded, and said tapped series winding is connected to a second end of said common winding.

20. The regulator of claim 19, wherein said common winding and said tapped series winding share a common core.

21. The regulator of claim 20, wherein on said common core said first tap changer section is adjacent to said common winding and said second tap changer section is adjacent to said first tap changer section.

22. The regulator of claim 15, wherein said first tap changer section provides only voltage increase capability, and said second tap changer section provides a symmetrical voltage increase/decrease characteristic such that together, said first tap changer section and second tap changer section provide said asymmetrical voltage increase/decrease characteristic between said input node and said output node of said regulator.

23. The regulator of claim 22, wherein said multiple switching units comprise nine switching units, said first tap changer section comprising three switching units, and said second tap changer section comprising six switching units.

24. The regulator of claim 22, wherein a first end of said common winding is grounded, and a second end of said common winding is connected to said first portion of said tapped series winding, and said first portion of said tapped series winding is connected to said second portion of said tapped series winding.

25. An inductive device for use within a power system, said inductive device comprising:

an input node and an output node;

an exciting winding and a series winding, said exciting winding being electrically coupled to said series winding, and said exciting winding and series winding being electrically coupled between said input node and said output node;

a tap changer system electrically connected to at least one of said exciting winding and said series winding; and wherein said inductive device has an asymmetrical voltage increase/decrease characteristic between said input node and said output node for enhanced regulation of either a voltage sag or a voltage swell, respectively, within the power system when used therein.

26. The inductive device of claim 25, wherein said tap changer system comprises an electronic tap changer system having a plurality of switching units and a controller for selectively activating selected ones of said switching units to provide a desired voltage increase/decrease between said input node and said output node of said inductive device.

27. The inductive device of claim 26, wherein said exciting winding and said series winding are disposed on different transformer cores.

28. The inductive device of claim 25, wherein said series winding comprises part of a series transformer, said series transformer having a core designed to magnetically saturate under fault current conditions between said input node and said output node, said magnetic saturation reducing current level within said tap changer system under said fault current condition.

* * * * *